US011813662B2

(12) United States Patent
Kahl

(10) Patent No.: US 11,813,662 B2
(45) Date of Patent: Nov. 14, 2023

(54) APPARATUS FOR PRODUCING A METAL GRID REINFORCEMENT AND MACHINE

(71) Applicant: MBK Maschinenbau GmbH, Kisslegg (DE)

(72) Inventor: Manfred Kahl, Isny (DE)

(73) Assignee: MBK Maschinenbau GmbH, Kisslegg (DE)

( * ) Notice: Subject to any disclaimer, the term of this patent is extended or adjusted under 35 U.S.C. 154(b) by 0 days.

(21) Appl. No.: 18/058,922

(22) Filed: Nov. 28, 2022

(65) Prior Publication Data

US 2023/0086409 A1 Mar. 23, 2023

Related U.S. Application Data

(63) Continuation of application No. PCT/EP2021/063365, filed on May 19, 2021.

(30) Foreign Application Priority Data

Jul. 2, 2020 (DE) ..... 10 2020 117 467.5

(51) Int. Cl.
*B21F 27/10* (2006.01)
*B21F 27/12* (2006.01)

(52) U.S. Cl.
CPC ..... *B21F 27/124* (2013.01)

(58) Field of Classification Search
CPC ..... B21F 23/00; B21F 27/12; B21F 27/121; B21F 27/122; B21F 27/124; B21F 27/10; B21D 43/006
See application file for complete search history.

(56) References Cited

U.S. PATENT DOCUMENTS 3,718,797 A 2/1973 Pfender
2008/0257445 A1 10/2008 Subacchi
2019/0001395 A1 1/2019 Hartenbauer

FOREIGN PATENT DOCUMENTS

DE 2 014 719 A1 10/1971
DE 27 20 970 A1 11/1978
(Continued)

OTHER PUBLICATIONS

WO 01/39908 A1, Neckoula Jun. 2001.*
(Continued)

*Primary Examiner* — Edward T Tolan
(74) *Attorney, Agent, or Firm* — BURR PATENT LAW, PLLC

(57) ABSTRACT

An apparatus for producing a metal grid reinforcement from metal profiles including longitudinal profiles and a winding profile, the apparatus having a welding unit for welding a longitudinal profile, and a winding profile guide guiding the winding profile, which can be fed from a provision location of the winding profile to the winding profile guide, to the welding unit. The winding profile guide has a contact side and a positioning side that are movable relative to one another, with the contact and positioning sides being matched such that a winding profile present between the contact and positioning sides is forced into a centered position when the positioning and contact sides are moved towards one another. The positioning side has a recess which is matched to the winding profile and into which a longitudinal portion of a centered winding profile engages.

18 Claims, 5 Drawing Sheets

(56) References Cited

FOREIGN PATENT DOCUMENTS

| | | | |
|---|---|---|---|
| DE | 10 2017 109 720 | A1 | 11/2018 |
| DE | 10 2018 112 925 | A1 | 12/2019 |
| WO | 2008/131346 | A2 | 10/2008 |
| WO | 2017/153602 | A1 | 9/2017 |
| WO | 2018/202532 | A1 | 11/2018 |
| WO | 2019/228845 | A1 | 12/2019 |

OTHER PUBLICATIONS

DE 4442483 A1, Duesterhoeft et al. May 1996.*
Translation, DE 4442483 A1, Duesterhoeft et al. May 1996.*
GB 2508470 A, Poole et al. Jun. 2014.*
WO 2016/063221 A, Priuli et al. Apr. 2016.*
KR 20070080259 A, Chung Aug. 2007.*
KR 2018098441 A, Choi et al. Sep. 2018.*
EP 2196271 A2, Galanos Jun. 2010.*
International Preliminary Report on Patentability (Chapter II) (Application No. PCT/EP2021/063365) (with Ch. II Claims) dated Feb. 21, 2022 (with English translation).
German Search Report (Application No. 10 2020 117 467.5) dated Mar. 8, 2021.
International Search Report and Written Opinion (Application No. PCT/EP2021/063365) dated Sep. 27, 2021.

* cited by examiner

APPARATUS FOR PRODUCING A METAL GRID REINFORCEMENT AND MACHINE

CROSS REFERENCE TO RELATED APPLICATIONS

This application is a continuation of International Application No. PCT/EP2021/063365 filed May 19, 2021, which designated the United States, and claims the benefit under 35 USC § 119(a)-(d) of German Application No. 10 2020 117 467.5 filed Jul. 2, 2020, the entireties of which are incorporated herein by reference.

FIELD OF THE INVENTION

The present invention relates to an apparatus for producing a metal grid reinforcement and machine.

BACKGROUND OF THE INVENTION

In mechanical engineering, machines for producing metal mesh reinforcements from metal profiles or steel profiles with multiple longitudinal profiles and with one winding profile are known.

Machines of this type have an apparatus with a welding unit for welding a longitudinal profile to a winding profile at a connecting point of the two metal profiles. The welding unit can be brought into a respective working position in relation to a main wheel of the machine. In addition, a winding profile guide is present that conveys the winding profile, which is guided up to the winding profile guide from a master, such as what is referred to as a coil, for example, to the welding unit.

These machines are in the form of a cage welding machine, for example, which serves to produce steel and/or metal mesh reinforcements, such as, in particular, reinforcing cages for shaft or concrete pipes, piles, supports or beams of concrete.

A machine makes it possible to manufacture various reinforcements for different pipes or supports with different outer diameters. In this respect, setting and equipping the machine to suit a respectively desired metal mesh reinforcement to be produced or interchanging the longitudinal and/or winding profiles to be processed is associated with a relevant expenditure on time and personnel. In particular, the welding unit of the machine must be set to a respective reinforcement outer dimension. Furthermore, it is usually the case that different winding profile diameters are processed, this entailing corresponding interruptions to the actual production process.

With regard to an economic use of such machines, what is desired, in particular, is a high degree of automation and minimized deployment of personnel, combined with process interruptions that are short as possible and a low susceptibility to faults of the machine operation.

WO 2017/153602 A1 relates to an apparatus for producing reinforcing cages.

SUMMARY OF THE INVENTION

It is an object of the present invention to improve the known machines for producing metal mesh reinforcements from metal profiles from an economic and technical perspective, in particular, with regard to the points mentioned above, such as the setting of the welding unit and the variable processing of different winding profiles.

The starting point of the present invention is an apparatus for producing a metal mesh reinforcement from multiple metal profiles, comprising multiple longitudinal profiles and one winding profile, wherein the apparatus has a welding unit for welding a longitudinal profile to a winding profile at a connecting point of the two metal profiles and a winding profile guide that conducts the winding profile, which can be guided up to the winding profile guide from a master of the winding profile, to the welding unit.

The apparatus is preferably in the form of a constituent part of a machine for producing a metal mesh reinforcement, such as a cage welding machine.

The essence of the present invention is that the winding profile guide has a contact side and a positioning side, wherein the contact side and the positioning side can be moved relative to one another, and wherein the contact side and the positioning side are matched to one another in such a way that a winding profile guided up between the contact side and the positioning side is forced into a centered position when the positioning side and the contact side are moved toward one another, wherein the positioning side has a depression which is matched to the winding profile and into which a longitudinal portion of a centered winding profile dips. The positioning side and the contact side are opposite one another. The guided-up winding profile is present in a positioning region between the positioning side and the contact side. In this respect, a longitudinal side of the winding profile faces the contact side and the other longitudinal side of the winding profile faces the positioning side. The free end, at the front in the direction of movement of the winding profile, of the winding profile faces toward the weld point or welding unit.

In order to set out the function of the apparatus, reference will be made below usually to the correct use of the apparatus as constituent part of a machine, such as a cage welding machine.

The present invention achieves disruption-free operation of the apparatus and, in useful operation with a corresponding machine, precise welding of the winding profile to the respective longitudinal profile at the desired point on the longitudinal profile or at the weld point.

In particular, what is achieved by this measure is that a respective winding profile which has been guided up to the winding profile guide during machine operation and is present first of all in a not accurately aligned position, which deviates or can deviate from the ideal or centered position of the winding profile for the welding, between the positioning side and the contact side is nicely aligned with respect to the weld point. When a new winding profile is guided up for the first time, the positioning side and the contact side are moved away from one another or leave enough intermediate space in a positioning region for the winding profile coming from the master on a run-in side of the winding profile guide to have sufficient room to be threaded in between the positioning side and the contact side. Subsequently, on account of the continuous conveying movement of the winding profile toward the welding unit, a portion of the winding profile is caught between the positioning side and the contact side. Then, the positioning side and the contact side move relatively toward one another. This effects the precise positioning or centering of the winding profile with respect to the weld point, on account of the relative movement of the positioning side and contact side. The winding profile centered with the aid of the depression and the contact side, with the winding profile being pressed against the contact side, leaves the winding profile guide precisely laterally positioned on a run-out side in such a way that the winding profile reaches the weld point spatially precisely, that is to say precisely reaches it in terms of direction and position. The weld point preferably is in line with or continues in a straight line the central longitudinal axis of the centered winding profile.

Since the winding profile, for example, a winding wire with a diameter of a few millimeters, is flexible, the winding profile has a tendency to deviate again from the centered position and alignment when even only over a small length no guide is present, e.g. after leaving the winding profile guide, toward the weld point on the longitudinal profile. This tendency increases as the end of the winding profile moving away from the winding profile guide gets further away. This means that the greater the distance is between a run-out side of the winding profile guide and the weld point, the greater the possible deviation of the winding profile centered in the winding profile guide is from the ideal position with respect to the weld point. It is therefore advantageous for the winding profile guide or the run-out side of the winding profile guide, at which the centered winding profile leaves the winding profile guide, to be as close as possible, preferably in the direct vicinity, of the weld point at which the winding profile is welded to the longitudinal profile. The distance between the run-out side of the winding profile guide and the weld point is preferably minimal or is measured for example in millimeters.

An explanation is given below as to the contact side being preferably somewhat slightly movable reversibly toward the welding unit.

After leaving the winding profile guide, the centered winding profile preferably reaches the weld point or the associated point of the longitudinal profile or on the longitudinal profile directly, for example, after one millimeter or after a few millimeters.

In particular, the winding profile reaches the point at which an electrode of the welding arrangement welds the winding profile to the longitudinal profile in a precisely aligned and/or positionally exact way. The electrode for welding, which will also synonymously be referred to below as welding electrode, is preferably in the form of a welding roller. In addition to the welding electrode, there is a contact electrode, which is preferably in the form of a contact roller. The terms "contact electrode" and "contact roller" and also the terms "welding electrode" and "welding roller" are used synonymously below. A flow of current required for the welding process is only possible when a flow of current is established over the profiles to be welded via the electrically conductively contacted welding electrode and contact electrode.

The arrangement according to the present invention makes it possible to avoid inaccuracies in or deviations from the ideal position of the guided-up winding profile at the weld point. This is advantageous, in particular, when changing over from one winding profile to another winding profile, e.g. with different winding profile diameters.

The relative movement between the contact side and the positioning side is preferably configured such that at least a portion of the positioning side or the contact side can be moved in a direction toward the contact side or positioning side and back again. The relative movement concerns a movement that makes an intermediate region between the depression and the contact side or the distance between them smaller and larger. The contact side is fixed or movable, for example. It is preferably the case that the positioning side is movable. Preferably, the contact side is stationary during the centering and then, when the winding profile is centered, reversibly movable in a direction, preferably in a direction of movement or longitudinal direction of the winding profile, in order to guide the centered winding profile to the weld point in a manner supported on the contact side.

The depression is preferably matched to the size and/or to the shape of the winding profile. For example, the depression has a maximum width which is e.g. the same or slightly smaller than an outer dimension or outer diameter of the winding profile. The centered winding profile is received within the depression preferably over its entire partial length that is present within the winding profile guide, and protrudes somewhat in the direction of the contact side, for example. The depression is preferably elongate and straight.

In principle, it is also possible to provide a depression on the contact side, preferably matched to the depression of the positioning side, e.g. mirrored or oppositely situated and/or similar or different in relation to the depression on the positioning side.

It is advantageous if the welding unit has a resiliently mounted electrode, wherein the welding unit can be brought into a predefinable working position in an automated manner before a process for producing a metal mesh reinforcement. Being brought into the working position means, in particular, that the entire welding unit together with the electrode or with the welding and contact electrodes is brought into a corresponding position relative to parts of the apparatus that remain in position or, when it is on a machine equipped with the apparatus, such as e.g. a cage welding machine, relative to a main wheel of the machine, for example.

The welding unit, preferably what is referred to as a welding carriage, is advantageously movably mounted on the whole. The welding electrode or the welding roller can also still be adjusted back and forth radially with respect to a central longitudinal axis, in particular, of the machine, relative to a contact electrode or to a contact roller of the welding unit. The adjustment is effected radially toward or away from the central longitudinal axis of a cage geometry that is to be produced during the production process. According to the present invention, this additional movement of the welding roller is automated.

The respective working positions differ, for example, in terms of their radial distance from an axis of rotation of the drivable main wheel of the machine, whereby the welding unit can be adapted to an e.g. outer diameter of the metal mesh reinforcement to be produced. The welding unit also brings the electrode into a working position. In the working position of the electrodes, when longitudinal profiles are present on the main wheel and a fed winding profile is present, the electrode or the welding electrode rests on the winding profile to be welded in the region of its contact with the longitudinal profile. The resilient mounting preferably comprises a spring member, with the result that the electrode makes contact with a preferably predefinable pressing force. This always happens within short time windows or in comparatively short instants while the main wheel is rotating, whenever a longitudinal profile arrives at the welding electrode. In this instant, a portion, arriving centered by the winding profile guide, of the winding profile then also lies between the longitudinal profile and the welding electrode, so that the welding takes place on account of the current flowing by means of the DC-conductively contacting contact electrode. At the instant of welding, the contact electrode is preferably in contact with an electrically conductively portion of the machine, which in turn itself is in conductive contact with a portion of the longitudinal profile in question that is offset in relation to the weld point. The welding current thus flows along the contact electrode, the longitudinal profile, the winding profile and the welding electrode.

The pressing contact of the electrode is advantageously yieldable or resettable, preferably resiliently. It is therefore possible, during working operation of a machine while the main wheel is rotating, for the electrode to resiliently yield, preferably in a radial direction with respect to the axis of rotation of the main wheel outward, and thereafter be returned automatically. While the main wheel is continuously rotating, the electrode advantageously permanently remains or always remains in touching or pressing contact with the winding profile. In this respect, it is not critical when small movements or offsets of the winding profile occur in a radial direction.

Overall, welding current is transferred to a sufficiently great extent, this being achieved owing preferably to a spring force which acts permanently on the electrode in the direction of the winding profile in accordance with the resilient mounting.

In principle, an in particular computer-assisted control unit of the apparatus and/or of the machine is present to manage the operation of the apparatus and/or the machine, respectively. Apart from general operational control and management, the control unit also preferably sets the working state or the working position of the welding unit in an automated manner.

The electrode comprises, in particular, a positive and a negative electrical terminal, with which DC contact can be made by electrically conductive portions, e.g. a contact electrode or e.g. preferably a contact roller of at least one copper material and a welding electrode or e.g. a welding roller. The respective electrode can be brought into electrically conductive contact with the associated metal profile or a portion electrically conductively connected thereto. The two electrodes are preferably mounted so as to be resiliently yieldable.

It is of advantage that, for the purpose of resilient mounting of the electrode, a cylinder/piston unit with a cylinder and a piston is provided, wherein the electrode is coupled to the piston, which is displaceable in the cylinder, wherein, after a contact position which is part of the working position and in which the electrode is in contact with a counterstop has been reached, a pressing action of the electrode against the counterstop can be set by a predefinable relative movement of the piston and the cylinder. The electrode is usually e.g. rigidly couplable to the piston via a piston rod. For this purpose, a pneumatic spring in accordance with a pneumatic cylinder/piston unit is preferably present, for example. This is a standard product, many different types of which are advantageously available on the market.

The resilient mounting relates advantageously to the welding electrode and/or the contact electrode.

The counterstop, which is variably selectable or positioned corresponding to or depending on the respective working position, may be formed at any desired point in the working region or along an adjustment distance of the welding unit. For example, the stop for the contact electrode is a portion of the longitudinal profile or a component portion of a machine on which the apparatus is located or of which the apparatus is part, or for the welding electrode is a portion of the winding profile.

The cylinder/piston unit or the pneumatic spring makes it possible, before the start of a working or welding process, to adjust the welding unit or the electrode, respectively, it being possible to set, in addition to the precise e.g. radial positioning on the main wheel, a pressing force of the electrode depending on the relative stroke. The relative stroke may be a predefinable stroke of the cylinder with respect to the piston, for example.

The setting can be automated by predefining a setpoint value "X" of the relative stroke, for example, in millimeters.

The cylinder/piston unit comprises in particular a pneumatic arrangement or pneumatic cylinder/piston unit having a pneumatic cylinder and a pneumatic piston for adapting the level of a pressing action or pressing force of the electrode or the welding electrode against the metal profile.

A sensor arrangement, for example, e.g. with a travel sensor for detecting the relative stroke of the cylinder with respect to the piston or the retraction stroke and for providing the information and transmitting it to the control unit, is provided for the predefinition of the setpoint value.

According to an advantageous modification, a positioning region is formed between the contact side and the positioning side such that a winding profile guided up to the apparatus can be received in the positioning region. The positioning region is a material-free air gap or gap region, for example. The gap region is formed by the, in particular, alterable distance between the contact side and the positioning side with the depression. The positioning region is preferably designed such that all possible outer dimensions of the different winding profiles that can be used can be guided through and centered in the positioning region. The winding profile is centered in the positioning region.

Advantageously, the positioning side is movably mounted. In this way, the winding profile can be centered with the depression of the positioning side, which can be moved toward the contact side and/or the winding profile present in the positioning region. The positioning side is preferably pivotably mounted, preferably so as to be able to pivot about a pivot pin, in particular, transversely with respect to the direction of movement, predefinable by the winding profile guide, of the winding profile through the winding profile guide.

The pivoting movement makes it possible to alter the spacing or the width of the positioning region or of the intermediate region between the positioning side and the contact side.

An advantageous configuration of the present invention is distinguished in that the contact side can be brought into contact with a first longitudinal side of the guided-up winding profile and in that the positioning side can be brought into contact with a second longitudinal side of the guided-up winding profile.

This makes it possible to gently clamp that longitudinal portion of the winding profile that is present in the positioning region of the winding profile guide in its longitudinal direction by way of the two oppositely situated longitudinal sides or by way of the first and the second longitudinal side between the positioning side and the contact side, and thus to center the winding profile in a longitudinal direction. In this respect, the positioning side with the depression acts on the winding profile in an essentially centering manner in that the corresponding second longitudinal side of the longitudinal portion of the winding profile dips into the depression in question. In the process, the until now not centered winding profile is slightly but relevantly set or moved into the centered alignment or position.

Another advantage emerges when the contact side can be moved reversibly back and forth in a longitudinal direction of a winding profile present in the positioning region. The movement of the winding profile from the winding profile guide toward the welding unit over the corresponding comparatively short distance is therefore supported. The contact side carries the winding profile along toward the welding unit in particular owing to friction.

The direction of movement of the contact side is preferably transverse to the direction of movement of the positioning side. Conversely, this means that e.g. the pivoting movement of the positioning side is directed substantially transversely with respect to the longitudinal direction of the winding profile.

That longitudinal portion of the winding profile that is centered between the contact side and the positioning side is moved toward the welding unit or the electrode in the process, without relevant forces or torques which would displace the winding profile out of the centered position acting on the winding profile owing to the movement of the contact side. The centered winding profile moved in a longitudinal direction thus remains in its centered alignment and at the same time is supported in this alignment as it moves toward the welding unit.

The contact side is preferably displaceable, e.g. displaceable linearly back and forth. For the guidance of the movement of the contact side, there is, for example, a guide slot, such as, for example, a slotted guide with a protruding guide element such as e.g. a pin, which is movable in a guide track such as e.g. a elongate-hole guide in a guided and delimited manner. The contact side preferably has a narrow slide strip with a contact surface for making contact with the centered winding profile, an outwardly protruding pin or multiple pins being present on a surface of the slide strip that is aligned e.g. at an angle in relation to the contact surface, which pin(s) engage in a matching elongate hole which delimits the movement on either side and are formed in a housing portion surrounding the contact side.

It is furthermore advantageous for the winding profile guide to have a run-in side, at which a front end of a winding profile that can be guided up from the master of the winding profile can be received by the winding profile guide. For example, the run-in side comprises a run-in gap or a run-in opening which allows the front free end of the winding profile to be threaded into the positioning region or into the winding profile guide. The run-in side is preferably present on a side of the winding profile guide that faces away from the welding unit or a side that faces the master.

It is also advantageous for the run-in side to adjoin the positioning region.

In this way, the winding profile coming from the run-in side, in particular, reaches the positioning region directly.

According to one variant of the present invention, the winding profile guide has a run-out side which is opposite the run-in side and at which the centered winding profile can be moved further toward the connecting point of the two metal profiles. The depression, from which the centered winding profile exits the winding profile guide, ends, in particular, at the run-out side. The run-out side, which is preferably opposite the run-in side, faces the welding unit or the electrode of the welding unit.

The depression preferably extends in a longitudinal direction of the depression from the run-in side of the winding profile guide to the run-out side of the winding profile guide. In this way, the winding profile is reliably centered and aligned in a guided manner from the run-in side to the run-out side.

The depression preferably extends evenly, for example in a straight line, from the run-in side to the run-out side. The depression has longitudinal edges which delimit the depression in its longitudinal direction on either side, for example, two linear longitudinal edges. Accordingly, for example, the oppositely situated, parallel longitudinal edges of the depression also extend from the run-in side to the run-out side. The depression is recessed in relation to the longitudinal edges, which delimit the depression on either side.

The depression is preferably in the form of a prism or is V-shaped or is cross-sectionally triangular, square or polygonal with a side that is open toward the contact side. The depression has strip-shaped flanks which are aligned at an angle to one another, for example. The at least two convergent flanks form an angle, for example, an obtuse or acute angle, e.g. in the region of 90 angular degrees.

The depression can thus cover a longitudinal portion of the winding profile over approximately half of the circumference. The contact between the depression and the centered winding profile is punctiform, linear or areal.

It has also emerged as advantageous for the positioning side to be present with the depression situated opposite a contact surface of the contact side.

The contact surface serves to support the centered winding profile received projectingly in the depression when the contact side and positioning side are moved toward one another. The winding profile is supported on the contact surface by way of that side of the winding profile that is situated opposite the side that is in the depression.

The contact surface preferably has an at least substantially planar configuration, for example, areal or strip-shaped.

The depression and/or the contact surface are preferably adapted such that, when the winding profile is positioned, a portion of the winding profile protrudes beyond the depression toward the contact surface of the contact side regardless of the outer dimension of the winding profile.

Advantageously, the depression comprises curved portions and/or straight portions. The depression can therefore be adapted virtually as desired to different outer shapes or outer dimensions of the winding profile.

The depression e.g. has a concave shape, is V-shaped or rectangular-channel-shaped or groove-shaped.

It is also advantageous for the electrode of the welding unit to be designed as yieldable on a resilient mounting during working operation, with the result that pressing contact is established between the electrode and a portion to be welded of the winding profile. At least one welding electrode of the welding unit, preferably also a contact electrode, is designed as yieldable on a resilient mounting during working operation.

Since the longitudinal profiles rotate past the electrodes of the welding unit with the main wheel rotating, the welding electrode and the contact electrode are preferably mounted so as to be able to rotate about an axis of rotation aligned parallel to an axis of rotation of the main wheel of an associated machine. The electrode comprises e.g. a welding roller of a highly electrically conductive copper material. During welding and working operation of the apparatus, the welding roller rotates continuously on a counter portion or circumferentially for a short time on the longitudinal profiles with the winding profile resting thereon. The welding is effected for a short time and at certain points.

It can be considered advantageous when the welding unit can be offset via a spindle drive, in order to set a working position of the welding unit. This has a compact structure and is robust and can be easily implemented by an electric drive.

It is furthermore advantageous for the welding unit to have a securing arrangement for locking a set working position of the welding unit. The securing arrangement is preferably incorporated in the drive for setting the working position of the welding unit.

A toothed rod with a toothed contour and a mating toothed contour connected to the welding electrode is preferably provided for this purpose. The toothed rod is moved linearly by way of a drive, such as e.g. the spindle drive or the electric drive, e.g. by means of a toothed wheel, for the purpose of setting the working position of the welding electrode. The permanently interlocking teeth serve to lock a set working position of the welding unit. In this way, secure working of the welding unit is always ensured.

The present invention similarly extends to a machine comprising a main wheel, which can be rotated in a driven manner, for receiving multiple longitudinal profiles, wherein an apparatus as per one of the designs described above is provided.

The machine with the apparatus is in the form of a cage welding machine, for example, which serves to produce steel and/or metal mesh reinforcements, such as, in particular, reinforcing cages for shaft or concrete pipes, piles, supports or beams of concrete.

The machine serves to produce a metal mesh reinforcement from multiple longitudinal profiles and one winding profile connected to the longitudinal profiles. The machine preferably has a feed unit and an advancing arrangement for the winding profile provided from a master or wound up on a coil. The machine moreover comprises, on either side of the main wheel and opposite to one another, a longitudinal profile positioning portion and a transporting portion with a rail guide for a linear movement of a pulling wheel that rotates simultaneously with the main wheel during operation and receives the finished face-side end of the metal mesh reinforcement.

BRIEF DESCRIPTION OF THE DRAWINGS

Further features and advantages of the present invention will be described in more detail with reference to a schematically illustrated exemplary embodiment of the present invention.

DETAILED DESCRIPTION OF THE INVENTION

Figure 1:
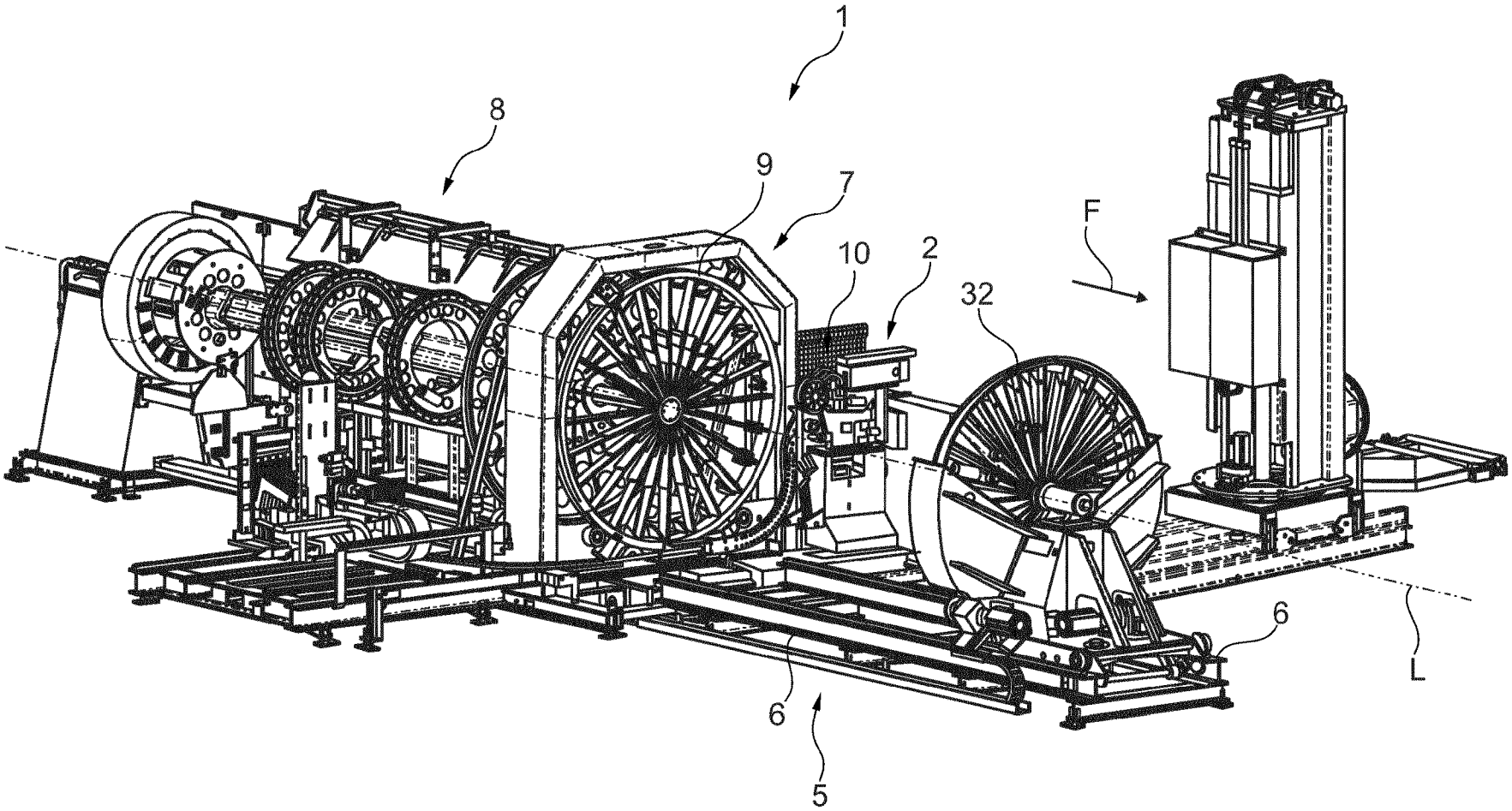
FIG. 1 shows a perspective overall view of a machine according to the present invention with an apparatus for producing a metal mesh reinforcement.
Figure 2:
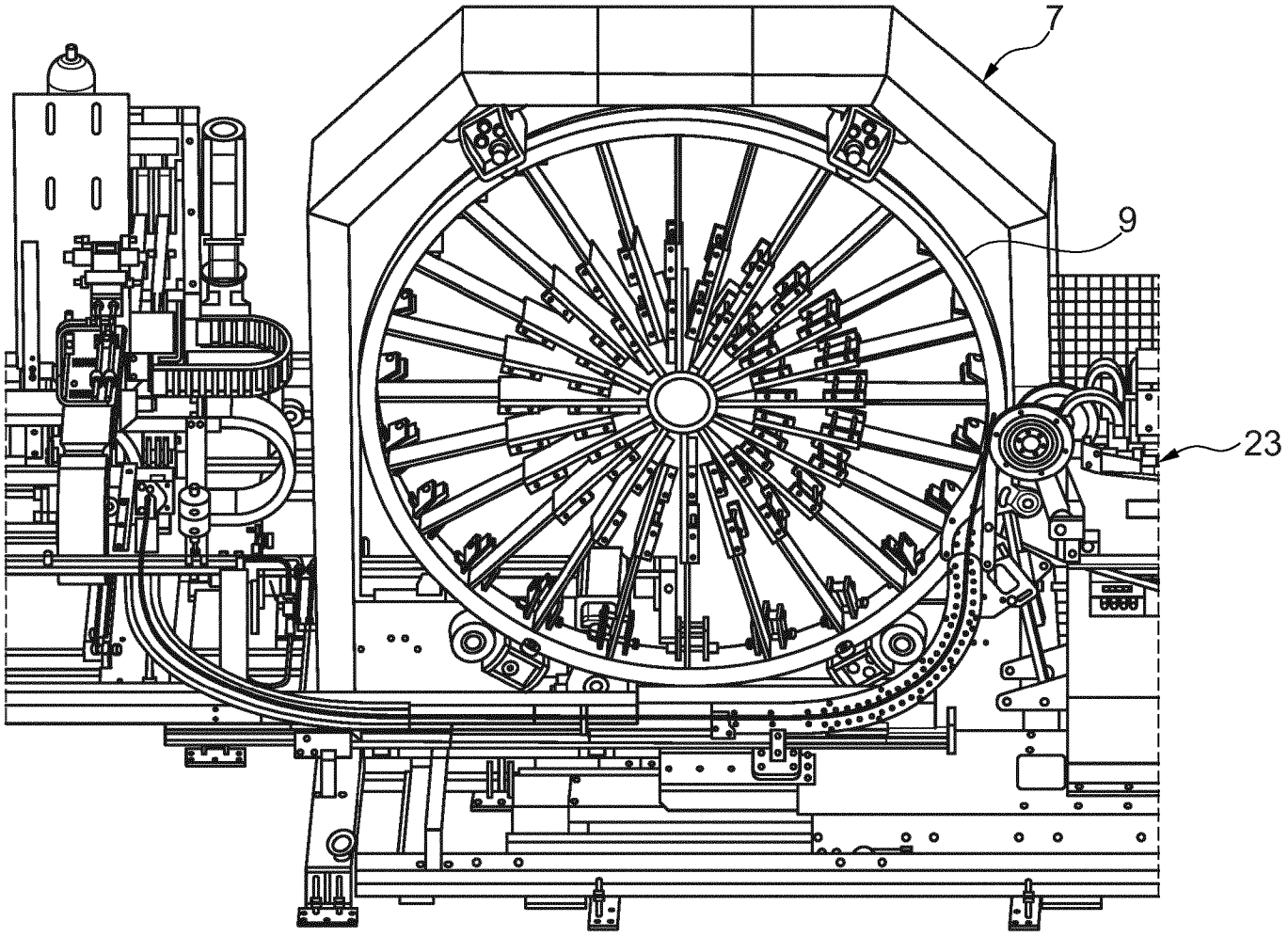
FIG. 2 shows a perspective individual view of a detail of the machine according to FIG. 1.
Figure 3:
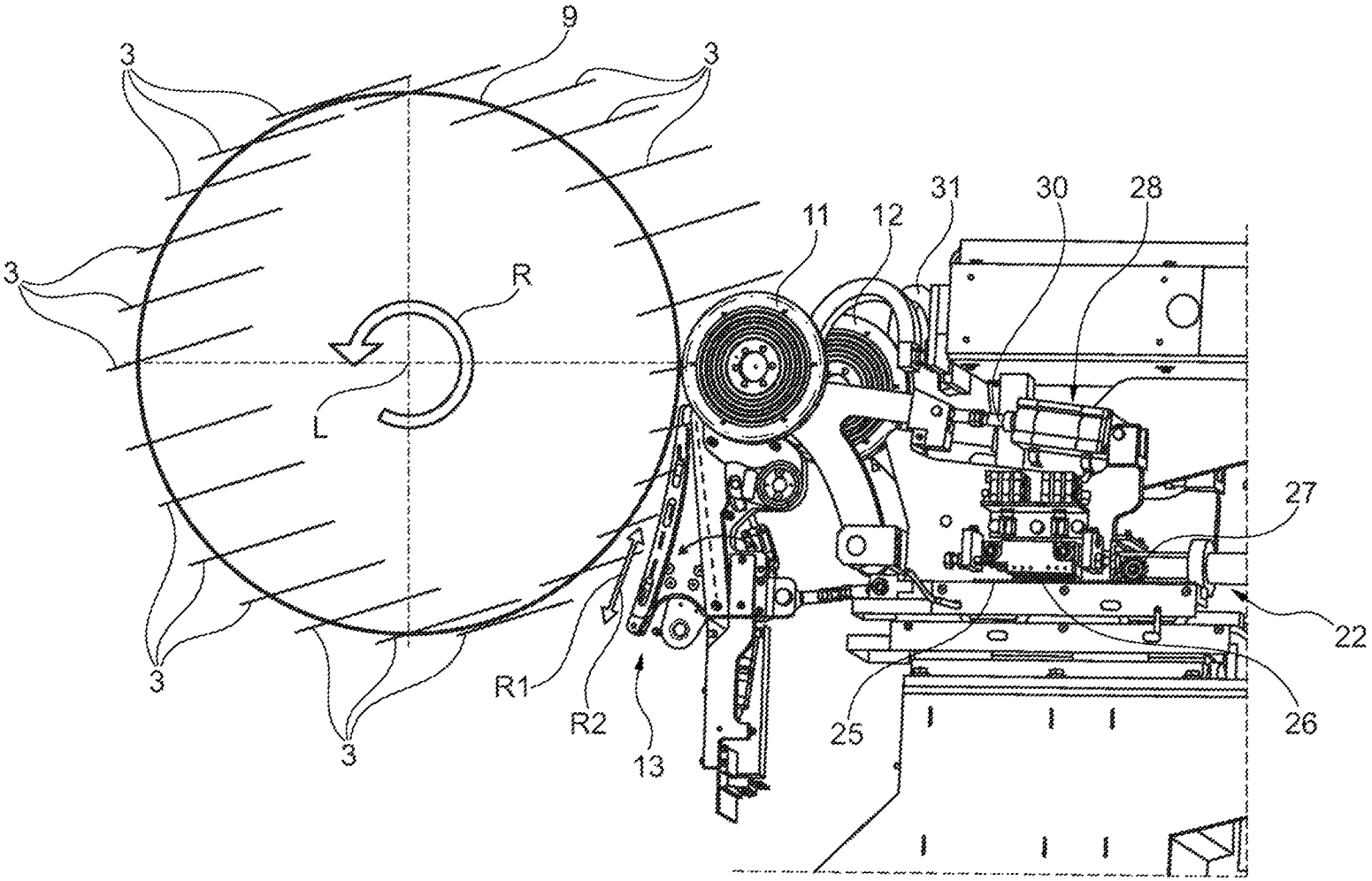
FIG. 3 shows a partially highly schematic view of a detail of the machine equipped with indicated longitudinal profiles according to FIG. 1.
Figure 4:
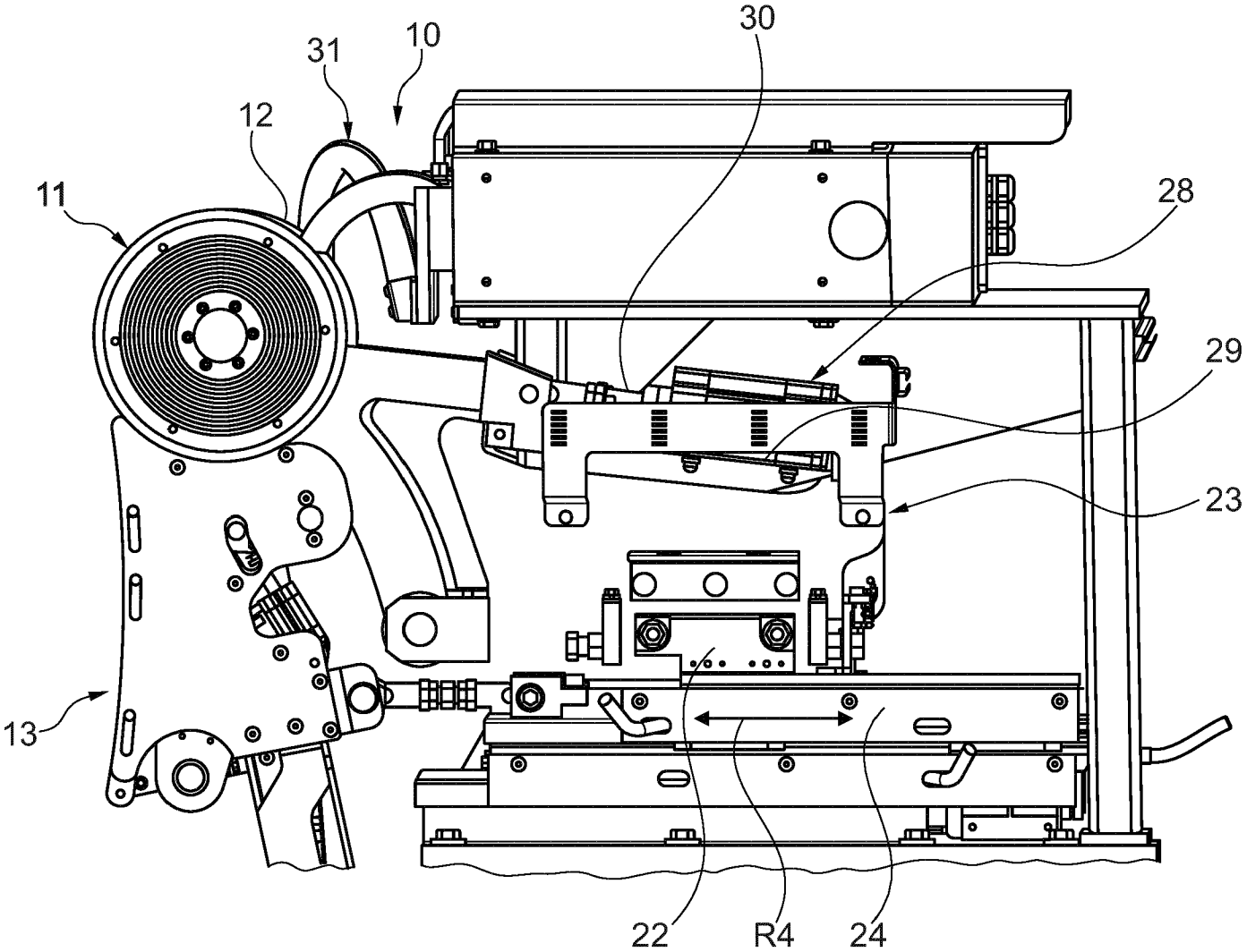
FIG. 4 shows a side view of a detail of the arrangement according to FIG. 3.
Figure 5:
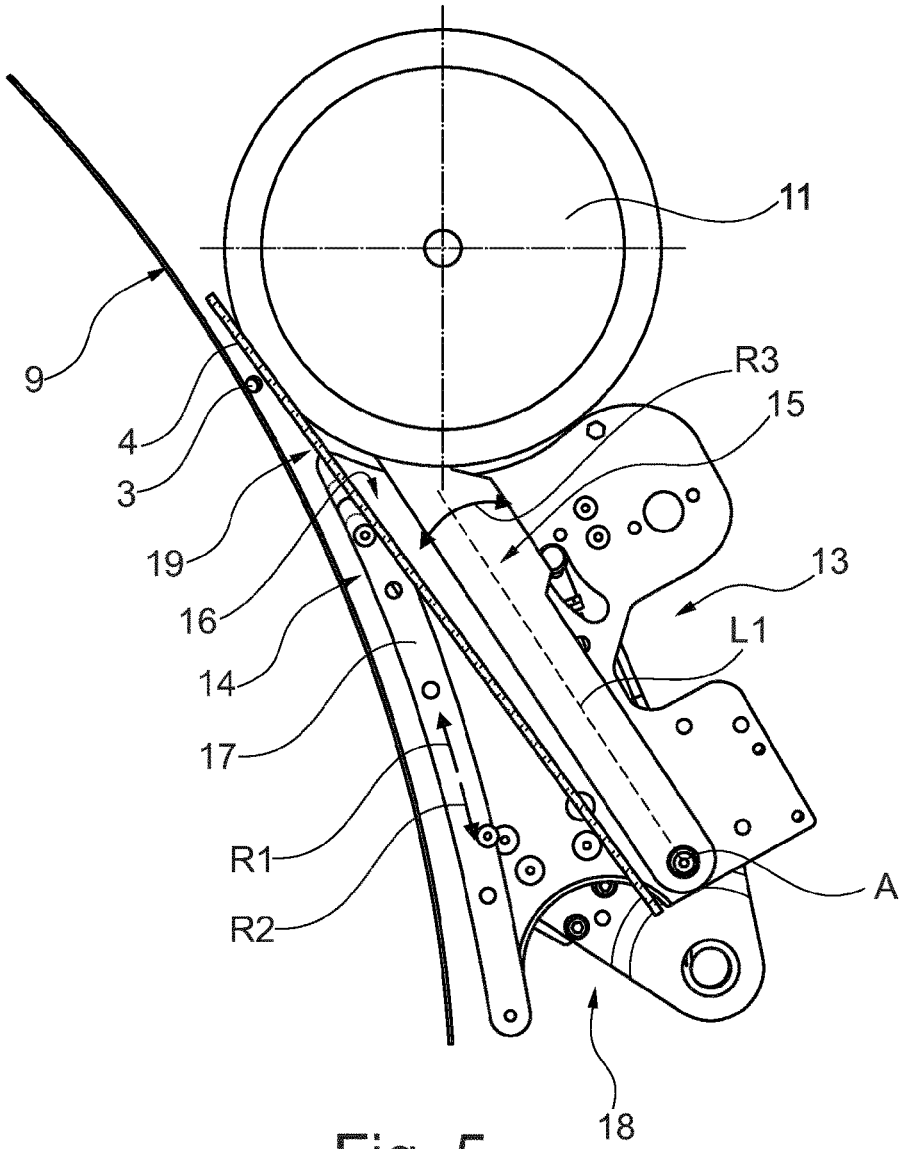
FIG. 5 shows a view of a detail of the arrangement according to FIG. 3 with a winding profile.
Figure 7:
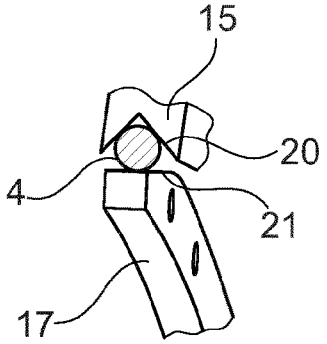
FIG. 7 shows a perspective view of a detail from FIG. 5.
Figure 6:
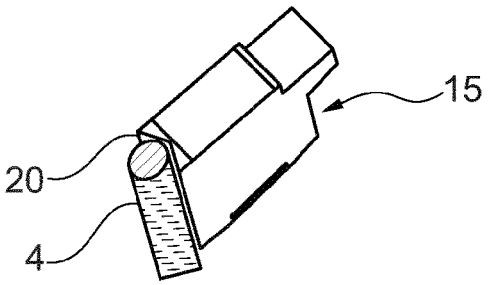
FIG. 6 shows a perspective individual view of a component from FIG. 5 with a cut winding profile.

FIG. 1 shows a perspective overall view obliquely from the front of a machine 1 according to the present invention, which has an apparatus 2 for producing a metal mesh reinforcement from multiple metal profiles, comprising longitudinal profiles 3 (see FIG. 3) and a winding profile 4 (see FIGS. 5-7).

The machine 1, such as a cage welding machine, for example, serves to produce steel and/or metal mesh reinforcements, such as, in particular, reinforcing cages for shaft or concrete pipes, piles, supports or beams of concrete.

In principle, a computer-assisted control unit of the machine 1 is provided to manage the operation of the machine 1 and of the apparatus 2. The control unit also sets the working state or the working position of a welding unit 10 of the apparatus 2 in an automated manner.

The reinforcement that can be produced has a plurality, for example, 24 or 48, of parallel longitudinal profiles 3 around a central longitudinal axis L of the machine 1, and a welded-on winding profile 4, such as a flexible winding wire, laid helically around the outside of the longitudinal profiles 3. The winding profile 4 is welded to all of the longitudinal profiles 3 at respective weld points on the finished metal mesh reinforcement preferably in one piece and uninterruptedly, the winding profile 4 being welded to all of the longitudinal profiles 3 in each case at multiple points, spaced apart in the longitudinal direction, of a longitudinal profile 3.

The machine 1 makes it possible to manufacture e.g. cylindrical reinforcing cages in one piece in a sustained manufacturing process and continuously. In this context, the continuously growing finished portion of the metal mesh reinforcement is advanced along a transporting portion 5 of the machine 1 in a conveying direction F.

The transporting portion 5 with a rail guide 6 is between a front end of the machine 1 and a frame portion 7 of the machine 1.

A positioning portion 8 adjoins the frame portion 3 rearwardly or opposite to the transporting portion 5, for the purpose of positionally correctly equipping the machine 1 with all of the longitudinal profiles 3 of the reinforcing cage to be produced before the start of the production operation for producing the reinforcement. In the process, the pre-positioned longitudinal profiles 3 are spaced apart from one another around the circumference and pushed in parallel to the central longitudinal axis L supported on portions of the positioning portion 8 that can be rotated about the longitudinal axis L.

The longitudinal profiles 3 are also supported on spoke-like portions of a main wheel 9 which are rotatable in a direction of rotation R about the longitudinal axis L in a manner driven by a motor. The main wheel 9, which is enclosed around the circumference on the outside by the frame portion 7, rotates in accordance with the rotational movement of the rotatable portions of the positioning portion 8. A pulling wheel 32, which rotates simultaneously with the main wheel 9 during operation, of the transporting portion 5 is provided for a linear movement of a partially finished metal mesh reinforcement. The pulling wheel 32 receives the finished face-side end of the metal mesh reinforcement or its front longitudinal profile ends.

For the purpose of welding the longitudinal profiles 3 to the winding profile 4, the apparatus 2 comprises the welding unit 10 with a welding electrode 11, for example, a welding roller, and a contact electrode 12, for example, a contact roller, offset in a longitudinal direction L in relation to the welding roller. The welding unit 10 serves to weld an associated portion of a respective longitudinal profile 3 to the winding profile 4 at a connecting point of the two profiles. Also part of the apparatus 2 is a winding profile guide 13, which conducts the winding profile 4, which can be guided up from a master, not illustrated, of the winding profile 4 to the winding profile guide 13, to the welding electrode 11 of the welding unit 10.

The master is e.g. a coil with a comparatively long piece of a winding profile 4 wound up helically on the coil.

The winding profile guide 13 allows the winding profile 4 to bridge and be positionally accurately aligned on the welding electrode 11, this concerning a final partial distance on the path of the winding profile 4, separated from the master, from the master to the welding unit 10. The winding profile guide 13 has a contact side 14 and a positioning side 15 situated opposite the contact side 14.

The front end of the winding profile 4 is threaded in at a run-in side 18 of the winding profile guide 13, the winding profile 4 being able to be received in a positioning region 16 formed between the contact side 14 and the positioning side 15 for accurate guidance and alignment thereof. The contact side 14, which comprises a preferably flat, displaceable slide strip 17, can be moved in a longitudinal direction of a winding profile 4 present in the positioning region 16 reversibly toward the welding electrode 11 in the displacement directions R1 and away from the welding electrode in the displacement direction R2 (see FIG. 5).

The positioning side 15 is mounted so as to be pivotable about an axis A in relation to the contact side by way of a longitudinal axis L1 of the positioning side 15. In this way, the positioning side 15 can be pivoted toward and away from the contact side 14 or the slide strip 17 in the pivoting directions R3.

The longitudinal portion of the winding profile 4, which is received in the positioning region 16 from the run-in side 18 to a run-out side 19, is centered and aligned by means of a depression 20, adapted to an outer shape and an outer dimension of the winding profile 4, of the positioning side 15 when the positioning side 15 is pivoted toward the contact side 14. FIG. 6 and FIG. 7 show the centering and alignment of the winding profile 4 in the depression 20. In this respect, the winding profile 4 is supported and positioned on a planar, flat contact surface 21 on the contact side 14.

The displacement of the contact side 14 or the slide strip 17 in the direction R1 causes the winding profile 4 to arrive at the welding electrode 11 at the point at which the winding profile is welded to a respective longitudinal profile 3. The winding profile 4 is forcibly moved at the same time.

The machine 1 makes it possible to produce reinforcing cages with different outer dimensions or different outer diameters. For this, the welding unit 10 is brought into a predefinable working position or a working state relative to the main wheel 9 in an automated manner before the start of a production process. In this respect, a radial distance between the welding unit 10 and the longitudinal axis L is altered. For this purpose, the welding unit 10 is received on a displaceable welding carriage 23, which may be displaced back and forth reversibly in a direction of movement R4 in a predefinable manner to the desired radial position along a linear guide 24 by means of a drive 22. The drive 22 is preferably an electric drive, such as a spindle drive, for example. The set working position is preferably locked, e.g. mechanically. A distinction should be made between the locking and a preferably present mounting play of the welding electrode 11 and/or the contact electrode 12. The mounting play is preferably always present and independent of the locked working position of the welding unit 10.

The locking is preferably done by a clamping mechanism. For example, a clamping mechanism is set up with the clamping mechanism having a toothing with a toothed rod 25, which comprises a toothed contour, and a mating toothed contour 26, which fits into the toothed contour of the toothed rod 25 (see FIG. 3). The linearly movable toothed rod 25 is linearly moved via the drive 22, such as the electric spindle drive, by means of a toothed wheel 27, that can be rotated by the drive 22, in order to set the working position of the welding unit 10. FIG. 5 shows a working position of the welding unit 10.

The welding unit 10 also brings the welding electrode 11 and the contact electrode 12 into a working position. In the working position of the electrodes, when longitudinal profiles 3 are present on the main wheel 9 and a fed winding profile 4 is present, the welding electrode 11 rests on the winding profile 4 to be welded in the region of its contact with the longitudinal profile 3. In order to allow a predefinable pressing force of the welding electrode 11 during working operation or to minimize influences caused by wear to the electrode material, the welding electrode 11 is mounted yieldingly or resiliently.

For the preferably resilient mounting and positioning of the welding electrode 11, a cylinder/piston unit 28 with a cylinder and a piston that can be moved relative to the cylinder is provided. The cylinder/piston unit 28 is preferably a pneumatic cylinder/piston unit. The welding electrode 11 is coupled to the piston that can be displaced in the cylinder via a piston rod 30 connected to the piston.

The contact electrode 12 is preferably also correspondingly pneumatic-spring mounted and positionable via a cylinder/piston unit, preferably a pneumatic cylinder/piston unit.

With each new metal mesh reinforcement to be produced, the complete welding carriage 23 together with the contact electrode 12 and the welding electrode 11 is moved in an automated manner until the contact electrode 12 rests on current collectors 31 by way of a lift.

Lift refers to a standard retracted state of the piston rod in question. This means that the welding carriage 23 is moved not just until contact is made with the contact electrode 12, but further by a value "X". This value "X" corresponds to the lift and is detected and signaled via a travel sensor 29 on or in the cylinder or in the pneumatic cylinder. The travel sensor 29 detects the retraction stroke and provides a corresponding signal to the control unit.

After this, a bracket, which is connected to the welding electrode 11 and movably mounted on the welding carriage 23, is likewise moved forward until the standard lift of the welding electrode 11 is also reached, this likewise being done by means of a travel sensor in a manner corresponding to the lift of the contact electrode 12 described above.

The lift is preferably predefined and set by means of the control unit in an automated manner.

This procedure according to the invention is advantageous with respect to a procedure which proceeds in reverse and in which the welding carriage is moved until a target state of the welding electrode is reached, and the contact electrode is manually set after this.

LIST OF REFERENCE SIGNS

1 Machine
2 Apparatus
3 Longitudinal profile
4 Winding profile
5 Transporting portion
6 Rail guide
7 Frame portion
8 Positioning portion
9 Main wheel
10 Welding unit
11 Welding electrode
12 Contact electrode
13 Winding profile guide
14 Contact side
15 Positioning side
16 Positioning region

17 Slide strip
18 Run-in side
19 Run-out side
20 Depression
21 Contact surface
22 Drive
23 Welding carriage
24 Linear guide
25 Toothed rod
26 Mating toothed contour
27 Toothed wheel
28 Cylinder/piston unit
29 Travel sensor
30 Piston rod
31 Current collector
32 Pulling wheel

The invention claimed is:

1. A machine having a driven, rotatable main wheel for receiving multiple longitudinal profiles, and having an apparatus for producing a metal mesh reinforcement from multiple metal profiles, comprising multiple longitudinal profiles and one winding profile, wherein the apparatus comprises a welding unit for welding a longitudinal profile to the winding profile at a connecting point of the two metal profiles and a winding profile guide that conducts the winding profile, which can be guided up to the winding profile guide from a master coil of the winding profile, to the welding unit, wherein the winding profile guide has a contact side and a positioning side, wherein the contact side and the positioning side can be moved relative to one another, and wherein the contact side and the positioning side are matched to one another in such a way that a winding profile guided up between the contact side and the positioning side is forced into a centered position when the positioning side and the contact side are moved toward one another, wherein the positioning side has a depression which is matched to the winding profile and into which a longitudinal portion of a centered winding profile dips, and wherein the contact side comprises a flat, displaceable slide strip.

2. The machine as claimed in claim 1, wherein the welding unit has a resiliently mounted electrode, wherein the welding unit can be brought into a predefinable working position in an automated manner before a process for producing a metal mesh reinforcement.

3. The machine as claimed in claim 2, further comprising a cylinder/piston unit with a cylinder and a piston, wherein the electrode is coupled to the piston, which is displaceable in the cylinder, wherein, after a contact position which is part of the working position and in which the electrode is in contact with a counterstop has been reached, a pressing action of the electrode against the counterstop can be set by a predefinable relative movement of the piston and the cylinder.

4. The machine as claimed in claim 1, wherein a positioning region is formed between the contact side and the positioning side such that a winding profile guided up to the apparatus can be received in the positioning region.

5. The machine as claimed in claim 1, wherein the positioning side is movably mounted.

6. The machine as claimed in claim 1, wherein the contact side can be brought into contact with a first longitudinal side of the guided-up winding profile and wherein the positioning side can be brought into contact with a second longitudinal side of the guided-up winding profile.

7. The machine as claimed in claim 1, wherein the contact side can be moved reversibly back and forth in a longitudinal direction of a winding profile present in the positioning region.

8. The machine as claimed in claim 1, wherein the winding profile guide has a run-in side, at which a front end of a winding profile that can be guided up from the master of the winding profile can be received by the winding profile guide.

9. The machine as claimed in claim 8, wherein the run-in side adjoins the positioning region.

10. The machine as claimed in claim 8, wherein the winding profile guide has a run-out side which is opposite the run-in side and at which the centered winding profile can be moved further toward the connecting point of the two metal profiles.

11. The machine as claimed in claim 10, wherein the depression extends in a longitudinal direction of the depression from the run-in side of the winding profile guide to the run-out side of the winding profile guide.

12. The machine as claimed in claim 11, wherein the positioning side is present with the depression situated opposite a contact surface of the contact side.

13. The machine as claimed in claim 11, wherein the depression comprises curved portions and/or straight portions.

14. The machine as claimed in claim 1, wherein the electrode of the welding unit is designed as yieldable on a resilient mounting during working operation, with the result that pressing contact is established between the electrode and a portion to be welded of the winding profile.

15. The machine as claimed in claim 1, wherein the welding unit can be displaced via a drive in order to set the working position of the welding unit.

16. The machine as claimed in claim 1, wherein the welding unit has a securing arrangement for locking a set working position of the welding unit.

17. The machine as claimed in claim 1, wherein the flat, displaceable slide strip is moveable in a longitudinal direction of the winding profile.

18. The machine as claimed in claim 10, wherein a distance between the run-out side of the winding profile guide and a weld point is less than or equal to 3 millimeters.

* * * * *